US005078351A

United States Patent [19]

Gualtieri

[11] Patent Number: 5,078,351

[45] Date of Patent: Jan. 7, 1992

[54] ADJUSTABLE LENGTH CYLINDER SUPPORT PILLAR FOR CHAIR SEAT

[75] Inventor: Massimo Gualtieri, Modena, Italy

[73] Assignee: Skillmatic SRL, Modena, Italy

[21] Appl. No.: 686,653

[22] Filed: Apr. 17, 1991

[30] Foreign Application Priority Data

May 21, 1990 [IT] Italy ..... 67367

[51] Int. Cl.[5] ..... F16M 11/00

[52] U.S. Cl. ..... 248/161; 188/300; 248/125; 248/404

[58] Field of Search ..... 248/404, 562, 161, 123.1, 248/601, 162.1, 125, 631; 188/300, 321.11; 267/64.12, 131, 132, 182; 297/345, 347

[56] References Cited

U.S. PATENT DOCUMENTS

| | | | |
|---|---|---|---|
| 3,913,901 | 10/1975 | Molders | 248/631 X |
| 4,113,220 | 9/1978 | Godwin | 297/347 X |
| 4,220,307 | 9/1980 | Hale | 297/347 X |
| 4,386,766 | 6/1983 | Bauer | 267/64.12 |
| 4,415,135 | 11/1983 | French | 267/131 X |
| 4,697,773 | 10/1987 | Jaumann | 248/123.1 X |
| 4,756,496 | 7/1988 | Hosan | 297/345 X |
| 4,817,898 | 4/1989 | Locher | 188/300 X |
| 4,828,080 | 5/1989 | Locher | 188/300 |
| 4,844,392 | 7/1989 | Bauer | 248/162.1 |

FOREIGN PATENT DOCUMENTS

| | | | |
|---|---|---|---|
| 1173916 | 12/1969 | United Kingdom | 248/162.1 |
| 2031057 | 4/1980 | United Kingdom | 248/631 |

*Primary Examiner*—J. Franklin Foss

*Attorney, Agent, or Firm*—Armstrong, Nikaido, Marmelstein, Kubovcik & Murray

[57] ABSTRACT

A cylinder of adjustable length comprises a cylinder body, two pistons slidable in the cylinder body, and a rod which is connected to both pistons and projects from one end of the cylinder body. A dividing wall forming part of the cylinder body defines a first chamber which faces one of the pistons and a second chamber which is separate from the first chamber and in which the other piston is slidable. The two chambers are filled with a fluid, preferably grease, and communicate with each other through a duct controlled by a remotely-controllable valve. The rod and the cylinder body can be locked in any relative position by the closure of the valve to prevent the passage of the fluid from one chamber to the other.

8 Claims, 3 Drawing Sheets

ADJUSTABLE LENGTH CYLINDER SUPPORT PILLAR FOR CHAIR SEAT

DESCRIPTION

The subject of the present invention is a cylinder of adjustable length, particularly for use as a support pillar for chairs, seats and the like.

A conventional technique in the field of support pillars for chairs of adjustable height consists of the provision of a hydropneumatic device having a cylinder in which a piston connected to a rod projecting from the cylinder can slide. The cylinder and its rod can be locked in any relative position by means of a valve which controls communication between the two chambers of the cylinder and which can cut off the communication to prevent the passage of fluid from one chamber of the cylinder to the other. The device also includes a chamber containing a gas under pressure which tends to bring the cylinder to its longest configuration.

Conventional devices of the type indicated above are quite complicated and expensive and lack reliability and safety.

In order to avoid these problems, the subject of the present invention is a cylinder of variable length, characterised in that it comprises:

a cylinder body, two pistons slidable in the cylinder body, a rod connected to both pistons and projecting from one end of the cylinder body, a dividing wall which forms part of the cylinder body and defines a first chamber facing one of the two pistons and a second chamber separate from the first chamber and facing the other piston, the first and second chambers being filled with a fluid, the dividing wall also having a duct which puts the first and second chambers into communication with each other, a remotely-controllable valve interposed in the duct and adapted to cut off the communication between the two chambers, preventing the passage of the fluid from one chamber to the other and consequently locking the rod relative to the cylinder body, a main helical spring interposed axially between the cylinder body and a support element which is slidable axially relative to the rod and is urged by the spring into abutment with a stop surface carried by the end of the rod outside the cylinder body, the main helical spring tending to urge the rod towards the position in which it projects furthest from the cylinder body, and an auxiliary helical spring which is interposed between the support element and a further stop surface carried by the rod and is intended to damp shocks tending to shorten the cylinder.

In a preferred embodiment, the fluid filling the two chambers of the cylinder according to the invention is grease. No pressurised gas is thus used in the device according to the invention, to the benefit of its reliability and safety. The main helical spring biases the cylinder towards its longest condition. When the valve is opened to enable the length of the cylinder to be adjusted, the cylinder can be shortened by the exertion thereon of a compression force sufficient to overcome the reaction of the main spring. The auxiliary helical spring attentuates the shocks to which the cylinder is subject, for example, when it is used as a support pillar for a chair. In this case, when the person sits down, an axial compressive force is created and this is discharged partly in the main helical spring but mostly in the auxiliary helical spring (which has a greater load than the main helical spring), protecting the parts of the cylinder from damage.

The invention will now be described with reference to the appended drawings, provided purely by way of non-limiting example, in which:

FIG. 1 shows schematically a chair 1 whose structure is carried by a pillar 2 produced according to the present invention.

Figure 1:
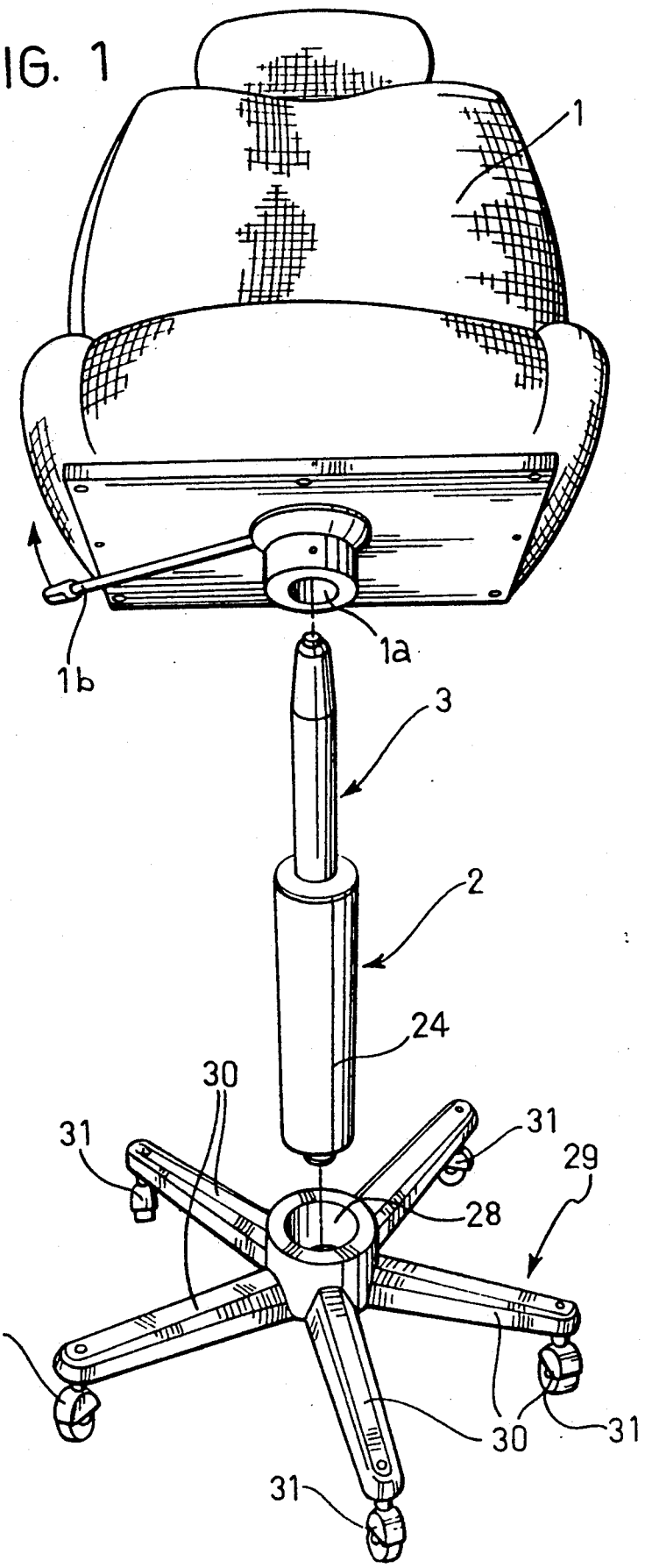
FIG. 1 is an exploded perspective view which shows an example of use of the device according to the invention.
Figure 2:
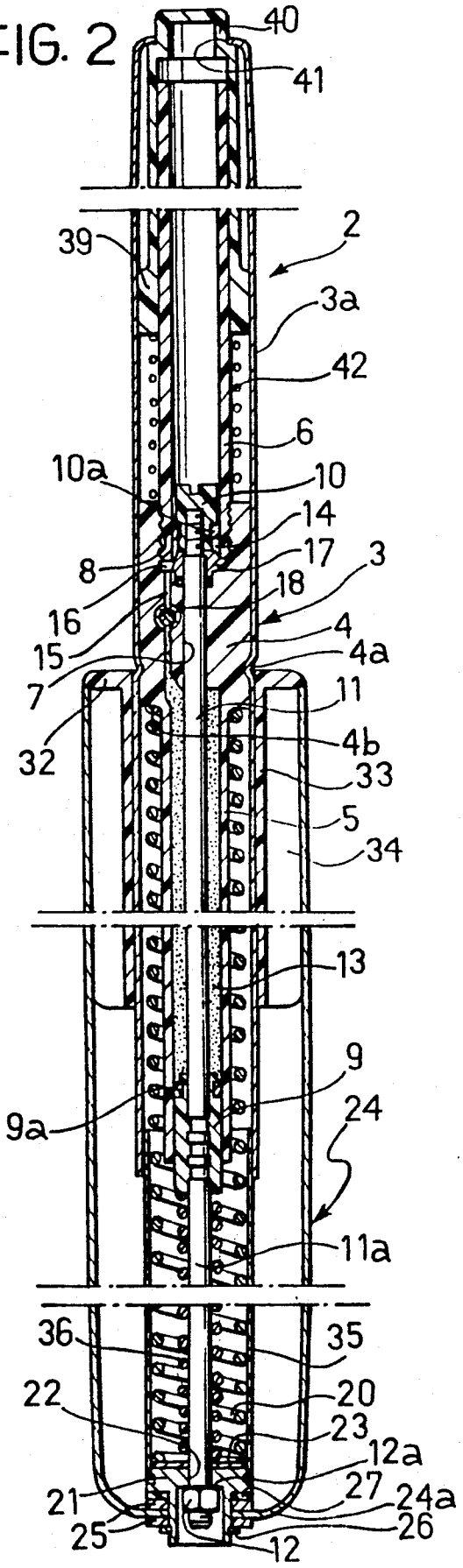
FIGS. 2 and 3 are two longitudinal sections of the device according to the invention in two different operating conditions.
Figure 3:
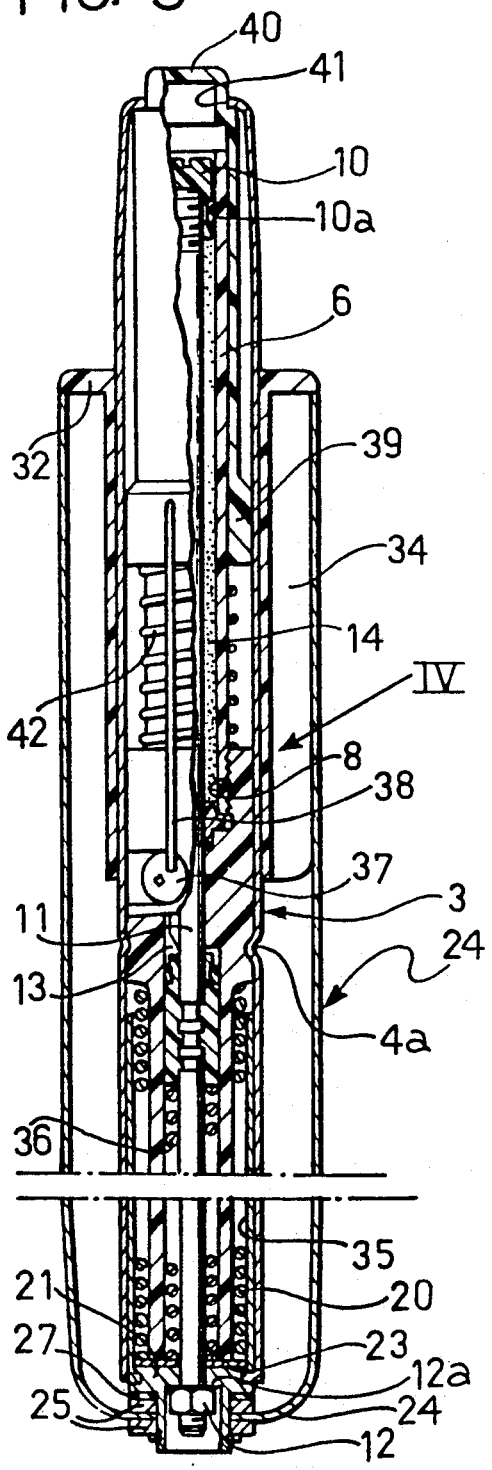

With reference to FIGS. 2-5, the device 2 comprises a cylinder body 3 which, in the embodiment illustrated, comprises a first element of plastics material including a body 4 and a first tube 5, and a second element 6 of plastics material constituting a second tube. The tubes 5, 6 project from opposite ends of the body 4 which has a central axial through-hole 7. The hole 7 has a widened end portion 8 which is threaded and into which a corresponding threaded end portion of the tube 6 is screwed. Pistons 9, 10 are slidable in the tube 5 and the tube 6 respectively. The piston 10 is constituted by a body of plastics material screwed onto a threaded end portion of a rod 11 which is slidable through the hole 7. The piston 9 is constituted by a body of plastics material moulded directly onto a portion of the rod 11. Finally, the latter has a portion **11*a* which projects from the tube 5 beyond the piston 9 and terminates in a threaded end portion onto which a nut 12 defining an annular stop surface 12*a*** is screwed.

The body 4 constitutes a dividing wall which defines a first chamber 13 facing the piston 9 and a second chamber 14 separate from the chamber 13 and facing the piston 10. The chambers 13, 14 are filled with a fluid, preferably grease. The chambers communicate with each other through a duct 15 formed in the body 4 and through a peripheral axial slot 16 (see FIG. 4) formed in a ring 17 through which the rod 11 passes and which is locked axially between the base wall of the threaded portion 8 and the respective end surface of the tube 6. The pistons 9, 10 are provided with sealing rings **9*a*, 10*a*. A sealing ring is also interposed between the ring 17 and the respective seat formed in the plastics element 4, the ring being indicated 17*a* in the drawings. A valve 18, whose operation will be described in detail below, is interposed in the duct 15 for controlling communication between the two chambers 13, 14**.

A main helical spring, indicated 20, is mounted coaxially around the tube 5 and is interposed axially between an annular abutment surface **4*b* of the element 4 and a support element 21, for example of brass, having a central hole 22 through which the rod 11*a* can slide. The helical spring 20 presses against the support element 21 by means of a washer 22 and urges the support element 21 against the stop surface 12*a* of the rod 11. Thus, when the valve 18 is open to enable fluid to pass freely between the two chambers 13, 14 so that the rod 11 is free to slide relative to the body of the cylinder 3, the helical spring 20 tends to urge the rod towards the position in which it projects furthest. In the embodiment illustrated, the support element 21 is constituted by a disc having on one of its faces a tubular appendage which is fixed to the base wall 24***a* of an outer protective tube 24 of metal. The element 21 is fixed to the base wall 24*a* with the interposition of a pair of rings 25, a circlip 26, and a plastics washer 27 so that the element 21, and consequently the whole unit constitued by the cylinder and the rod 11, is free to rotate about its axis relative to the protective tube 24. This is done so as to enable the chair to rotate about the axis of the cylinder. With reference to FIG. 1, the lower end of the tube 24 is housed in a seat 28 in a base structure 29 which, in the embodiment illustrated, includes a plurality of spokes 30 with casters 31.

The upper end of the tube 24 is closed by a plastics cap 32 which extends to form a tube 33 in which a metal tube 3*a* is slidable, the tube 3*a* being fixed to the plastics element 4 by permanent deformation in correspondence with a groove 4*a* and having end portions surrounding the tubes 5, 6 coaxially. The outer surface of the tube 33 has radial spacer fins 34 whose outer edges are in contact with the inner surface of the tube 24.

A further plastics tube 35 fixed to the support element 21 is housed slidably in the end portion of the metal tube 3*a* and has the function of preventing any curvature of the spring 20.

Moreover, a helical spring 36 with a load greater than that of the spring 20 is interposed between the piston 9 and the washer 23 and serves to attenuate shocks to which the device is subject whenever a person sits down on the chair 1, as will be described in further detail below.

Figure 4:
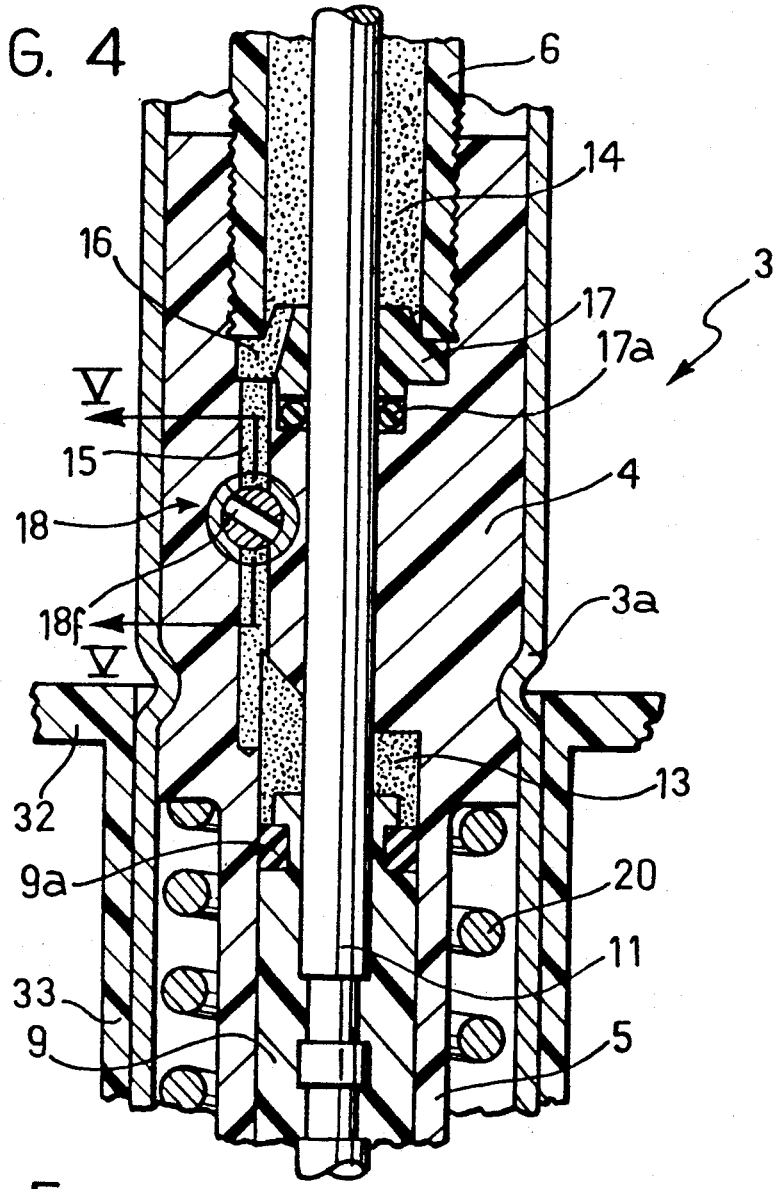
FIG. 4 shows the detail IV of FIG. 3 on an enlarged scale.
Figure 5:
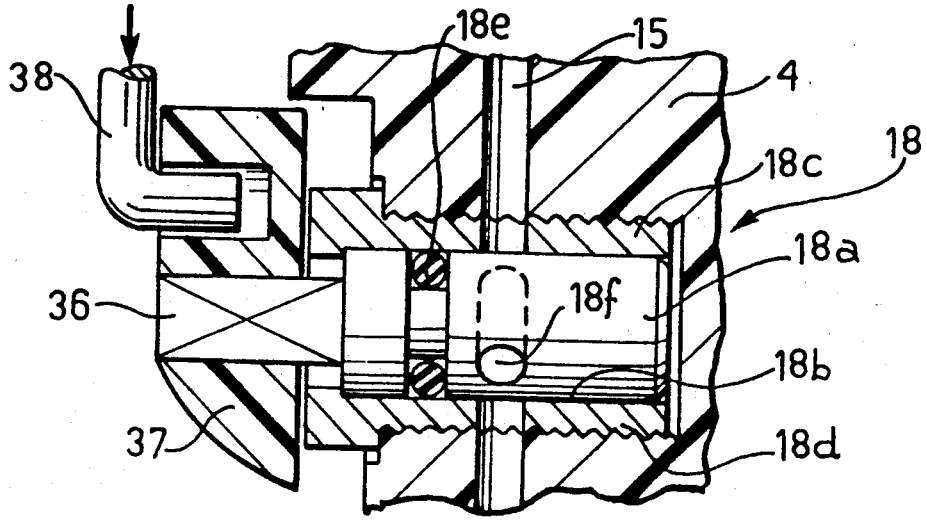
FIG. 5 is a section taken on the line V—V of FIG. 4, on an enlarged scale.

With specific reference to FIGS. 4 and 5, the valve 18 comprises a cylindrical body 18*a* mounted rotatably in a cylindrical seat 18*b* defined by a threaded metal bush 18*c* which is screwed into a threaded hole 18*d* formed in the plastics element 4 in such a position that the hole 18*d* intersects the duct 15 which puts the two chambers 13, 14 into communication. The body of the valve 18*a* has a sealing ring 18*e* and a diametral hole 18*f* for re-establishing communication through the duct 15 when the body 18*a* is oriented such that the hole 18*f* is aligned with the duct 15. The angular position of the body 18*a* is controlled by a shank 36 carrying a lever 37 to which the end of a rod 38 is fixed. The opposite end of the rod 38 is fixed to a slidable cap 39 (FIG. 2) which can slide axially between the tube 6 and the respective portion of the outer tube 3*a*. The cap 39 has a head 40 which projects through an aperture 41 in the top of the outer tube 3*a*. A helical spring 42 is interposed between the element 4 and the bottom surface of the cap element 39 so as to urge the cap element upwards to the position which corresponds to the closure of the valve 18 (shown in FIG. 4). In this condition, the communication between the two chambers 13, 14 is cut off and the rod 11 is locked relative to the body of the cylinder 3 since the fluid present in the chambers 13, 14 is not free to pass from one chamber to the other. In order to adjust the height of the chair, the head 40 of the cap element 39 must be pushed downwards so as to cause the body of the valve 18 to move towards its open position in which the two chambers 13, 14 intercommunicate. In the embodiment illustrated, the upper end of the tube 3*a* is housed in a seat 1*a*formed in the lower surface of the seat 1. The chair also has an operating lever 1*b* with an end which is in contact with the head 40 and is adapted to urge the head downwards against the action of the spring 42.

The device according to the invention operates as follows:

when the user is not acting on the lever 1*b*, the spring 42 keeps the valve 18 in the closed position shown in FIG. 4. In this condition, the fluid in the chambers 13, 14 is not free to flow from one chamber to the other and the rod 11 is therefore locked relative to the body of the cylinder 3. If the user wishes to adjust the height of the chair, he must act on the lever 1*b* so as to bring the valve 18 to the open position which corresponds to the alignment of the hole 18*f* with the duct 15. When communication is established between the chambers 13, 14, the rod 11 is free to slide relative to the body of the cylinder 3. In this condition, the helical spring 20 tends to bring the pillar to its most extended condition. If the height of the chair is to be increased, therefore, it suffices to assist the action of the spring until the desired height is reached, after which the lever 1*b* should be released to lock the pillar as a result of the closure of the valve 18 by the action of the spring 42. If the user wishes to lower the chair, however, he must exert sufficient downward force with his own weight to overcome the action of the spring 20. In this case also, when the desired height is reached, the pillar can be locked by the release of the lever 1*b*.

The compressive force exerted on the device at the moment when a person sits on the chair 1 does not expose the parts of the device to the risk of damage because it is discharged to the spring 36 and, in this condition, the cylinder 3 and the rod 11 constitute a single unit which is free to slide downwards relative to the support element 21.

It is clear from the above description that the structure of the device according to the invention is particularly simple and reliable.

Naturally, the principle of the invention remaining the same, the details of construction and forms of embodiment may be varied widely with respect to those described and illustrated purely by way of example, without thereby departing from the scope of the present invention.

I claim:

1. A cylinder of adjustable length, particularly for use as a support pillar for a chair, seat or the like, comprising:

a cylinder body, two pistons slidable in the cylinder body, a rod connected to both pistons and projecting from one end of the cylinder body, a dividing wall which forms part of the cylinder body and defines a first chamber facing one of the two pistons and a second chamber separate from the first chamber and facing the other piston, the firs and second chambers being filled with a fluid, the dividing wall also having a duct which puts the first and second chambers into communication with each other, a remotely-controllable valve interposed in the duct and adapted to cut off the communication between the two chambers, preventing the passage of the fluid from one chamber to the other and consequently locking the rod relative to the cylinder body, a main helical spring interposed axially between the cylinder body and a support element which is slidable axially relative to the rod and is urged by the helical spring into abutment with a stop surface carried by the end of the rod outside the cylinder body so that the main helical spring tends to urge the rod towards the position in which it projects furthest from the cylinder body, and an auxiliary helical spring which is interposed between the support element and a further stop surface carried by the rod and is intended to damp compressive forces to which the cylinder is subject.

2. A cylinder according to claim 1, wherein the cylinder body comprises a cylindrical portion from which two tubes project in opposite directions, the pistons being slidable in the tubes and the cylindrical portion also being provided with an outer tube which extends axially in both directions so as to surround the two tubes coaxially, the rod having an end portion which projects beyond the end of one of the tubes and is slidale in a hole in the support element.

3. A cylinder according to claim 2, wherein the support element is freely rotatable on the base wall of a protective tube which is closed at its upper end by a cap provided with a tubular element in which the outer tube of the cylinder body is slidable.

4. A cylinder according to claim 1, wherein the stop surface of the rod is defined by a nut screwed onto a threaded end portion of the rod.

5. A cylinder according to claim 3, wherein the auxiliary helical spring is interposed axially between the support element and one of the pistons.

6. A cylinder according to claim 5, wherein the valve comprises a rotatable valve body with a diametral hole which is aligned with the communication duct between the two chambers when the valve is in the open position, the rotatable body being controlled by a cap element which is mounted slidably between one of the tubes which form parts of the cylinder body and its outer tube, by means of an operating rod, the cap element being subject to the action of a spring which biases the valve to the closed position and having a head which projects through an aperture in the top of the outer tube of the cylinder.

7. A cylinder according to claim 1, wherein the fluid filling the two chambers is grease.

8. A cylinder according to claim 1, wherein the auxiliary helical spring has a greater load than the main helical spring.

* * * * *